US008096153B2

(12) United States Patent
Vogan

(10) Patent No.: US 8,096,153 B2
(45) Date of Patent: Jan. 17, 2012

(54) METHOD AND APPARATUS FOR SECURING EQUIPMENT AT A WORKSTATION

(75) Inventor: Richard A. Vogan, Derby, NY (US)

(73) Assignee: International Business Machines Corporation, Armonk, NY (US)

( * ) Notice: Subject to any disclaimer, the term of this patent is extended or adjusted under 35 U.S.C. 154(b) by 736 days.

(21) Appl. No.: 11/238,870

(22) Filed: Sep. 29, 2005

(65) Prior Publication Data

US 2007/0068203 A1 Mar. 29, 2007

(51) Int. Cl.
*E05B 73/00* (2006.01)

(52) U.S. Cl. ..... 70/58; 70/14; 70/57.1

(58) Field of Classification Search ..... 70/49, 57.1, 70/58, 63, 14
See application file for complete search history.

(56) References Cited

U.S. PATENT DOCUMENTS 4,308,733 A * 1/1982 Tampa ..... 70/259
4,676,080 A * 6/1987 Schwarz ..... 70/59
4,979,382 A * 12/1990 Perry ..... 70/58
5,050,836 A * 9/1991 Makous ..... 70/58
5,082,232 A * 1/1992 Wilson ..... 248/551
5,349,834 A * 9/1994 Davidge ..... 70/58
5,351,507 A 10/1994 Derman
5,361,610 A 11/1994 Sanders
5,709,110 A 1/1998 Greenfield et al.
5,794,463 A * 8/1998 McDaid ..... 70/58
5,904,056 A * 5/1999 Ozaki ..... 70/58
6,000,251 A * 12/1999 Murray et al. ..... 70/58
6,006,557 A * 12/1999 Carl et al. ..... 70/58
6,105,922 A * 8/2000 Derman ..... 70/58
6,182,481 B1 * 2/2001 Nagy ..... 70/58
6,193,207 B1 * 2/2001 Umberg ..... 248/551
6,305,199 B1 * 10/2001 Igelmund ..... 70/58
6,308,928 B1 10/2001 Galant
6,360,405 B1 3/2002 McDaid et al.
6,389,853 B1 5/2002 Pate et al.
6,418,014 B1 * 7/2002 Emerick, Jr. ..... 70/58
6,689,954 B2 * 2/2004 Vaughan et al. ..... 70/57.1
6,735,990 B1 * 5/2004 Murray et al. ..... 70/58
6,742,366 B1 * 6/2004 Lai ..... 70/58

* cited by examiner

*Primary Examiner* — Suzanne Barrett
*Assistant Examiner* — Christopher Boswell
(74) *Attorney, Agent, or Firm* — William E. Schiesser; Anna L. Linne

(57) ABSTRACT

Under the present invention, methods and apparatus for securing equipment at a workstation are provided. Portable security apparatus for preventing unauthorized removal or theft of equipment from a workstation at which such equipment resides are disclosed. The apparatus utilize a hole in a surface of a workstation so as to not require permanent attachment to the workstation. A security cable may be utilized in combination with the security apparatus to secure equipment at a workstation. Construction and installation methods for the apparatus are also disclosed.

10 Claims, 6 Drawing Sheets

METHOD AND APPARATUS FOR SECURING EQUIPMENT AT A WORKSTATION

FIELD OF THE INVENTION

The present invention generally relates to methods and apparatus for securing equipment at a workstation. Specifically, the present invention relates to use of apparatus to prevent unauthorized removal or theft of equipment from a work area without requiring permanent attachment to the work area.

BACKGROUND OF THE INVENTION

The problem of theft and authorized or unlawful removal of electronic equipment from the premises on which such equipment resides has been a problem for many years. Electronic equipment provides an attractive target for theft because of the relative ease with which such equipment is transported, as well as the relatively high resale value of such equipment on the black market. This problem has been exacerbated in recent years by a reduction in size and miniaturization of such equipment. Equipment such as laptop or notebook computers, portable printers, portable scanners, personal digital assistants ("PDAs"), cellular telephones, Global Positioning System Receivers ("GPS Units"), and other types of expensive equipment designed for portability are all highly susceptible to unlawful removal if not properly secured. Further, the information stored on such devices may be proprietary or confidential in nature, and may have a value which is equal to or greater than the device itself. If such information, for example plans for a company's new, unannounced product in which a considerable investment has been made, were to fall into the hands of a competitor, the loss of such information could far exceed the value of the equipment. Further, the nature of contemporary work environments is often that of a temporary workspace provided for mobile workers. It is difficult to easily secure equipment in such an environment as a given work area is assigned to a given worker on a temporary basis, and permanent installation of an apparatus to secure equipment may not, therefore, be practical. It is also often difficult to secure equipment when visiting a customer or client location while on a sales call or acting as a technical consultant, for example, when no permanent work area is assigned.

Most previous attempts to solve these types of problems have involved the use of cable locks that may be looped around a table, desk, or other type of furniture leg or member. However, this method of securing equipment may be easily defeated by lifting the furniture and/or sliding the cable lock around the end of the furniture leg or member. Further, such use of cable locks is often cumbersome, and frequently requires a user to climb under furniture while requesting assistance from another person to effect installation of the cable lock. These limitations have been addressed by permanently affixing secure mounting hardware, for example a metal eye or loop, to the furniture or a wall at a convenient location using either a fastener such as a screw, or an adhesive. A cable lock may then be passed through the secure mounting hardware, thereby providing an improved apparatus to prevent equipment from being removed. However, this apparatus also has limitations. It is not always desirable to attach fasteners such as screws to expensive furniture, as this typically involves drilling holes in the furniture. Further, tools required to attach such fasteners, such as a drill, drill bits, or a screwdriver, may not be readily available. Adhesives do not provide an ideal solution either, inasmuch as adhesives require a period of time to cure and harden before becoming effective, and even then may be easily defeated with a tool such as a chisel. Further, the use of adhesives may mar expensive furniture.

Accordingly, there exists a need in the art to overcome the deficiencies and limitations described hereinabove.

SUMMARY OF THE INVENTION

In general, the present invention provides apparatus for preventing unauthorized removal of equipment from the premises on which such equipment resides. The present invention further provides apparatus that are portable, and which reliably secure equipment at a work area, without requiring permanent attachment to the work area. The present invention further provides construction and installation methods for the apparatus.

In accordance with an embodiment of the invention, there is provided a method for constructing an apparatus adapted to secure equipment at a workstation, the method comprising providing a malleable member, forming the member into an apparatus such that a first portion of the apparatus may be passed through a hole in a surface of the workstation, while preventing a second portion of the apparatus from being passed through the hole, wherein ends of the member are contained in the first portion, and forming a loop in at least one end of the member, wherein the loop may be passed through the hole, and wherein a security cable may be passed through the loop.

In accordance with another embodiment of the invention, there is provided an apparatus adapted to secure equipment at a workstation, comprising a first portion of the apparatus that may be passed through a hole in a surface of the workstation, wherein the first portion is adapted to receive a security cable, and a second portion of the apparatus that may not be passed through the hole.

In accordance with yet another embodiment of the invention, there is provided a method for securing equipment at a workstation, the method comprising providing an apparatus having a first portion that may be passed through a hole in a surface of the workstation, and a second portion that may not be passed through the hole, wherein the first portion has at least one aperture adapted to receive a security cable, passing the first portion of the apparatus through the hole in the surface of the workstation, passing a security cable through the at least one aperture in the first portion of the apparatus, and attaching the security cable to the equipment.

In accordance with yet another embodiment of the invention, there is provided an apparatus adapted to secure equipment at a workstation, comprising a first baffle that may not be passed through a hole in a surface of the workstation, and a member in contact with the first baffle, wherein at least a portion of the member is capable of passing at least partially through the hole, and wherein the member is adapted to receive a security cable.

In accordance with yet another embodiment of the invention, there is provided a method for securing equipment at a workstation, the method comprising providing a first baffle that may not be passed through a hole in a surface of the workstation, providing a member in contact with the first baffle, wherein at least a portion of the member is capable of passing at least partially through the hole, and wherein the member has an eye adapted to receive a security cable, passing the member at least partially through the hole in the surface of the workstation, passing a security cable through the eye of the member, and attaching the security cable to the equipment.

Therefore, the present invention provides methods and apparatus for securing equipment at a workstation.

BRIEF DESCRIPTION OF THE DRAWINGS

These and other features of this invention will be more readily understood from the following detailed description of the various aspects of the invention taken in conjunction with the accompanying drawings in which.

Figure 1:
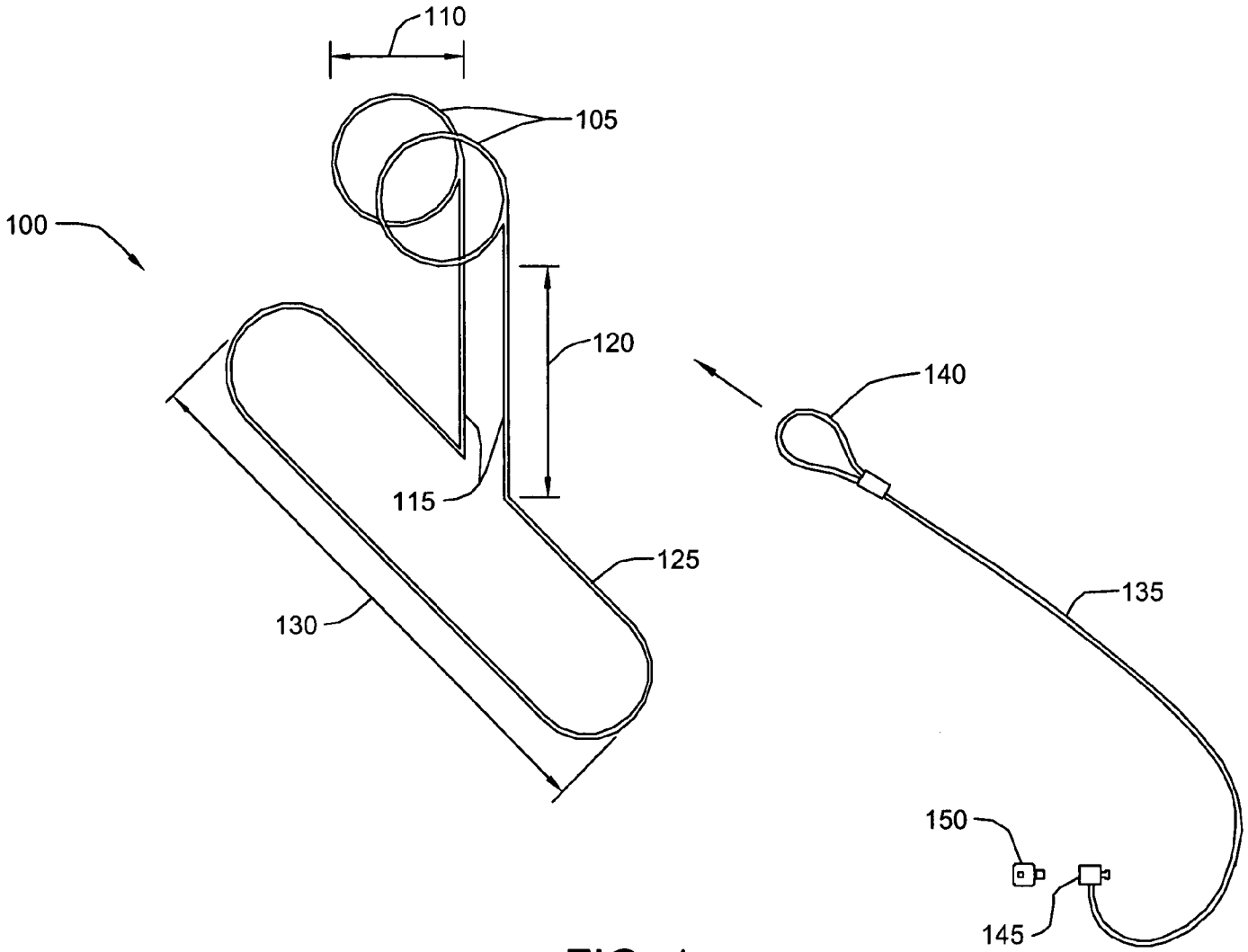
FIG. 1 depicts an apparatus in accordance with an embodiment of the present invention.

The drawings are not necessarily to scale. The drawings are merely isometric or schematic representations, not intended to portray specific parameters of the invention. The drawings are intended to depict only typical embodiments of the invention, and therefore should not be considered as limiting the scope of the invention. In the drawings, like numbering represents like elements.

BEST MODE FOR CARRYING OUT THE INVENTION

Contemporary work environments are often little more than a temporary workspace provided for mobile workers. Accordingly, it is difficult to easily secure equipment in such an environment as a given work area is assigned to a given worker on a temporary basis, and permanent installation of an apparatus to secure equipment may not, therefore, be practical. It is also often difficult to secure equipment when visiting a customer or client location while on a sales call or acting as a technical consultant, for example, when no permanent work area is assigned. Accordingly, there exists a need in the art for portable apparatus which prevent unauthorized removal or theft of equipment by reliably securing the equipment at a work area, without requiring permanent attachment to the work area. There further exists a need for construction and installation methods for such apparatus.

As indicated above, the present invention provides methods and apparatus for securing equipment at a workstation. Specifically, under the present invention, apparatus for preventing unauthorized removal or theft of equipment from a work area, or from the premises on which such equipment resides, is provided. The present invention further provides apparatus that are portable, and which reliably secure equipment at a work area, without requiring permanent attachment to the work area. The present invention further provides construction and installation methods for the apparatus.

Furniture used in contemporary work environments such as desks, workstations, work areas, and the like, often provide one or more holes in a surface of the furniture. These holes, sometimes referred to as "cable holes" are provided to allow power and other cables utilized by computers and other electronic equipment to be passed though the surface of the furniture in a simplified and unobtrusive manner. The present invention provides another use for these holes, to wit, securing computers or other electronic equipment to the furniture having the one or more holes. In the present description, the term "workstation" is understood to mean all types of furniture, desks, or any other type of work area having such holes.

Referring now to the drawings, FIG. 1 depicts apparatus 100 adapted to secure equipment at a workstation in accordance with an embodiment of the present invention. In one example, apparatus 100 may be constructed by providing a malleable member, such as a piece of metal or metal alloy. In one example, the member may be a steel or steel alloy wire of gauge twelve (12) or thicker. In another example, the member may be a piece of extruded aluminum. In any event, the member should preferably be comprised of a material that may be shaped or formed into a formed shape using, for example, a metal rolling machine, a sheet metal press, or a rod bending machine. Once formed using the machines and/or presses mentioned hereinabove, the material comprising the member should be able to be bent to a small extent by hand, in one example less than one inch, but should be sufficiently rigid so as to not be easily bent beyond this small extent by hand or using common hand tools. Further, the material comprising the member should be sufficiently elastic and resilient so as to return to the formed shape when bent less than the small extent mentioned hereinabove.

In one example, apparatus 100 may be formed from the member into the shape depicted in FIG. 1 using the machines and/or presses mentioned hereinabove. Specifically, apparatus 100 may have loops 105 formed in the ends of the member, each having size or diameter 110, in one example about two inches, so as to allow loops 105 to be passed through a hole in a surface of a workstation, while allowing a security cable to be passed through loops 105 as described hereinbelow. Necks 115 have length 120, in one example 2 inches, which allows loops 105 to be partially or completely passed through a hole in a surface of a workstation. Loops 105 and any parts of necks 115 that may be passed through a hole in a surface of a workstation may also be referred to as a first portion of apparatus 100. It should be noted that the interior or aperture of at least one of loops 105 of the first portion of apparatus 100 is adapted to receive a security cable as described hereinbelow.

In one embodiment, loops 105 and necks 115 of the first portion of apparatus 100 may be offset, in one example by one half of an inch, such that when preparing the first portion of apparatus 100 for passage through a hole in a surface of a workstation, loops 105 and necks 115 may be grasped and compressed by a user so as to allow passage through the hole. This embodiment provides a further advantage of apparatus 100 returning to an original, uncompressed state after the first portion is passed through the hole, thereby preventing apparatus 100 from falling back through the hole during installation.

Second portion 125 of apparatus 100 has diameter or length 130 such that second portion 125 may not be passed through the hole in the surface of the workstation. Second portion 125 may be round, or oblong (as depicted in FIG. 1), or have any other shape, so long as second portion 125 is of a sufficient size so as to prevent passage through the hole in the surface of the workstation.

In one embodiment, the member may have a plastic or painted coating to aid in the prevention of rust or corrosion, and to provide additional durability for apparatus 100. The plastic or painted coating may be applied to the member either prior to, or subsequent to, the forming of the member into apparatus 100 by being dipped in a liquid plastic compound, powder coating, spray painting, or any other known method of applying a plastic or painted coating. The plastic or painted coating may also be provided in a variety of colors, so as to provide an aesthetically pleasing appearance to a user of apparatus 100.

Security cable 135 may be any type of security cable having loop 140 at one end, and lock 145 adapted to secure equipment at another end. The end of security cable 135 having loop 140 may be passed through the interior or aperture of at least one of loops 105 subsequent to apparatus 100 having been passed through a hole in a surface of a workstation. Size or diameter 110 of loops 105 should be sufficiently large so as to allow passage of loop 140 through loops 105. It should be understood that loops 105 need not have the same size or diameter 110 as depicted in FIG. 1. Each of the loops comprising loops 105 could have different sizes or diameters, or loops 105 could comprise a single loop as described hereinbelow with respect to FIG. 2. In any event, once loop 140 has been passed through loops 105, the end of security cable 135 having lock 145 may be passed through loop 140. Equipment may then be secured by attaching lock 145 to the equipment using key 150.

In one example, security cable 135 may be a Kensington MicroSaver® security cable. (MicroSaver® is a Registered Trademark of ACCO World Corporation.) However, any type of security cable having the features described hereinabove may be utilized with the present invention. In general, such security cables are known, and further description is not believed necessary.

Figure 2:
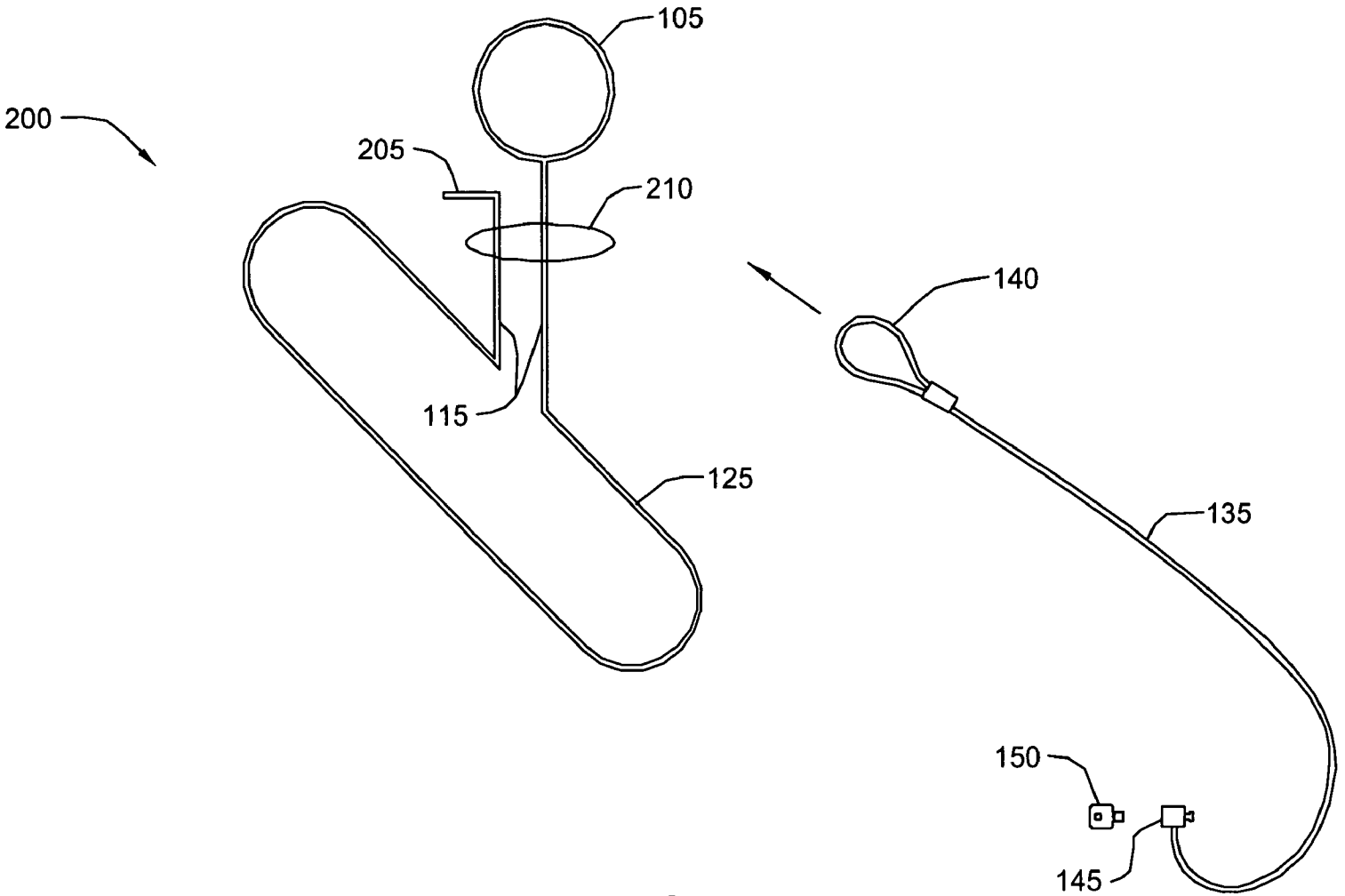
FIG. 2 depicts an apparatus in accordance with an embodiment of the present invention.

Referring now to FIG. 2, an embodiment of the present invention, apparatus 200, is depicted. Apparatus 200 may be formed from a member in a manner similar to that described hereinabove for apparatus 100 of FIG. 1. Apparatus 200 is similar to apparatus 100, however, apparatus 200 has a single loop 105 at one end of the member from which apparatus 200 was formed. As depicted in FIG. 2, angled end 205 is at one end of the member from which apparatus 200 was formed, rather than a loop as in apparatus 100. In a manner similar to that described hereinabove for apparatus 100 of FIG. 1, loop 105 has a diameter, in one example about two inches, that allows loop 105 and angled end 205 to be passed through a hole in a surface of a workstation, while allowing a security cable to be passed through loop 105 as described hereinbelow.

Angled end 205 may be utilized, inter alia, to prevent apparatus 200 from falling back through hole 210 in a surface of a workstation during installation. Angled end 205 is depicted in FIG. 2 as having an angle of 90 degrees with respect to the member from which apparatus 200 was formed, however a lesser or greater angle may be utilized so long as the angle serves to prevent apparatus 200 from falling back through hole 210 in a surface of a workstation during installation.

In a further similar manner to that described hereinabove for apparatus 100 of FIG. 1, loop 105, angled end 205, and any parts of necks 115 that may be passed through hole 210 in a surface of a workstation may also be referred to as a first portion of apparatus 200. In one embodiment, loop 105, angled end 205, and necks 115 of the first portion of apparatus 200 may be offset, in one example by one half of an inch, such that when preparing the first portion of apparatus 200 for passage through hole 210 in a surface of a workstation, loop 105, angled end 205, and necks 115 may be grasped and compressed by a user so as to allow passage through hole 210. When apparatus 200 returns to an original, uncompressed state after the first portion is passed through hole 210, apparatus 200 is thereby prevented from falling back through hole 210. In any event, it should be noted that the interior or aperture of loop 105 of the first portion of apparatus 200 is adapted to receive a security cable as described hereinbelow.

In a further similar manner to that described hereinabove for apparatus 100 of FIG. 1, second portion 125 of apparatus 200 has a diameter or length such that second portion 125 may not be passed through hole 210 in the surface of the workstation. As with apparatus 100, the member from which apparatus 200 was formed may have a plastic or painted coating applied using the methods described hereinabove for apparatus 100.

In a further similar manner to that described hereinabove for apparatus 100 of FIG. 1, an end of security cable 135 having loop 140 may be passed through the interior or aperture of loop 105 subsequent to apparatus 200 having been passed through hole 210 in a surface of a workstation. Size or diameter of loop 105 should be sufficiently large so as to allow passage of loop 140 through loop 105. Once loop 140 has been passed through loop 105, an end of security cable 135 having lock 145 may be passed through loop 140. Equipment may then be secured by attaching lock 145 to the equipment using key 150.

In one example, apparatus 100 and apparatus 200 may be constructed from a plastic material, such as Zytel®, utilizing an injection molding process. (Zytel® is a Registered Trademark of E.I. du Pont de Nemours and Company.) However, any type of plastic material, plastic resin, or durable polyamide polymer that cannot be easily deformed or broken would be suitable for use with apparatus 100 and apparatus 200. An injection mold in conjunction with a mold press, for example a Cincinnati Milacron® VS33 or VS55 mold press, may be utilized to form apparatus 100 and apparatus 200. (Cincinnati Milacron® is a Registered Trademark of Cincinnati Milacron Inc.) However, in general, plastic injection molding processes are known, and further description is not believed necessary.

Figure 3:
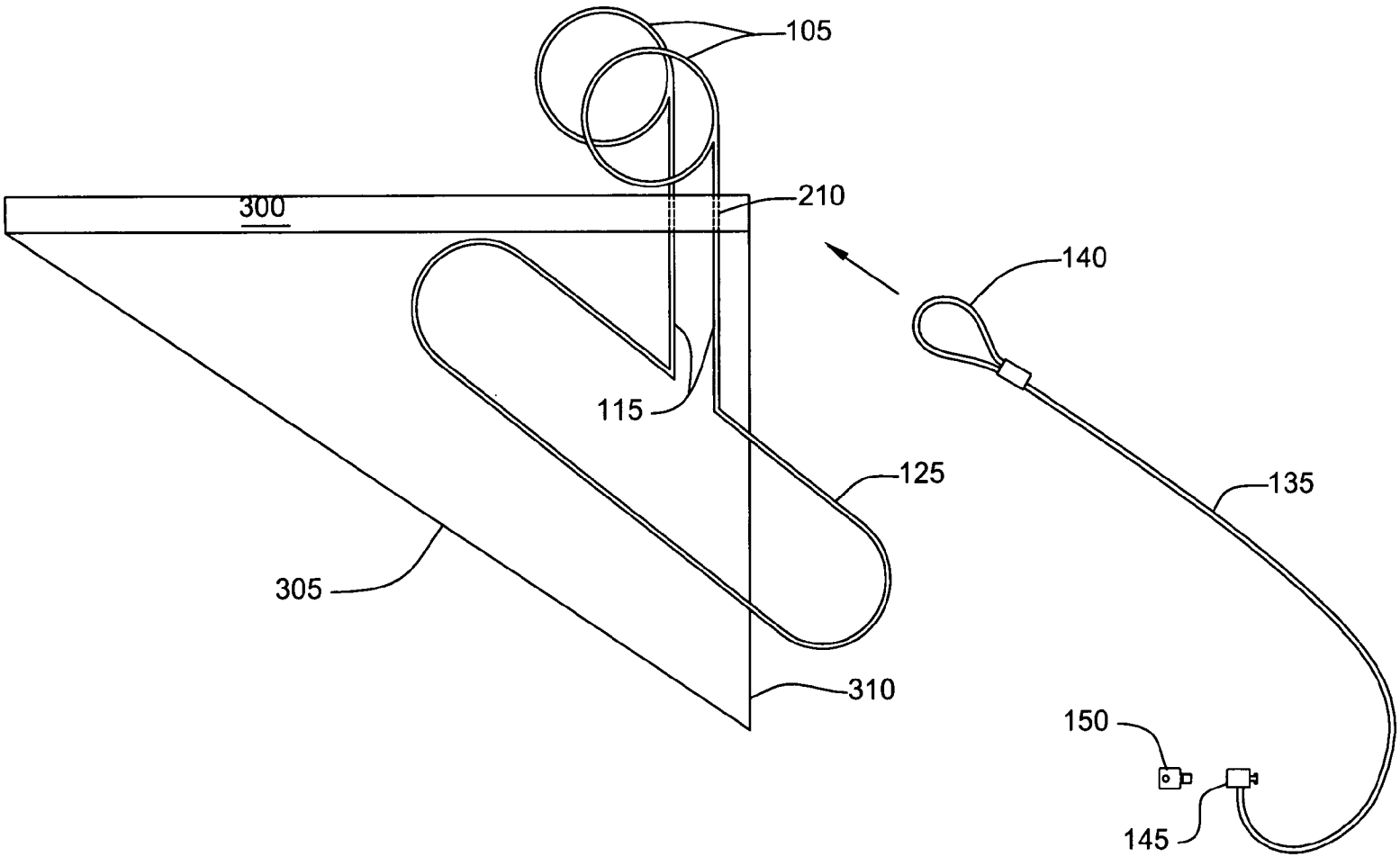
FIG. 3 depicts an apparatus placed in a work area in accordance with an embodiment of the present invention.

Referring now to FIG. 3, apparatus 100 of FIG. 1 is depicted installed in hole 210 of workstation surface 300. Support member 305 provides support and bracing between surface 300 and vertical member 310. In one embodiment, vertical member 310 may be a structural wall, and in another embodiment may be a vertical panel of a desk or other type of workstation. In a manner similar to that described hereinabove with respect to apparatus 100 of FIG. 1, loops 105 and portions of necks 115 may be passed through hole 210 in surface 300. In a further similar manner, an end of security cable 135 having loop 140 may be passed through at least one of loops 105, an end of security cable 135 having lock 145 may be passed through loop 140, and equipment may be secured by attaching lock 145 to the equipment using key 150.

Figure 4A:
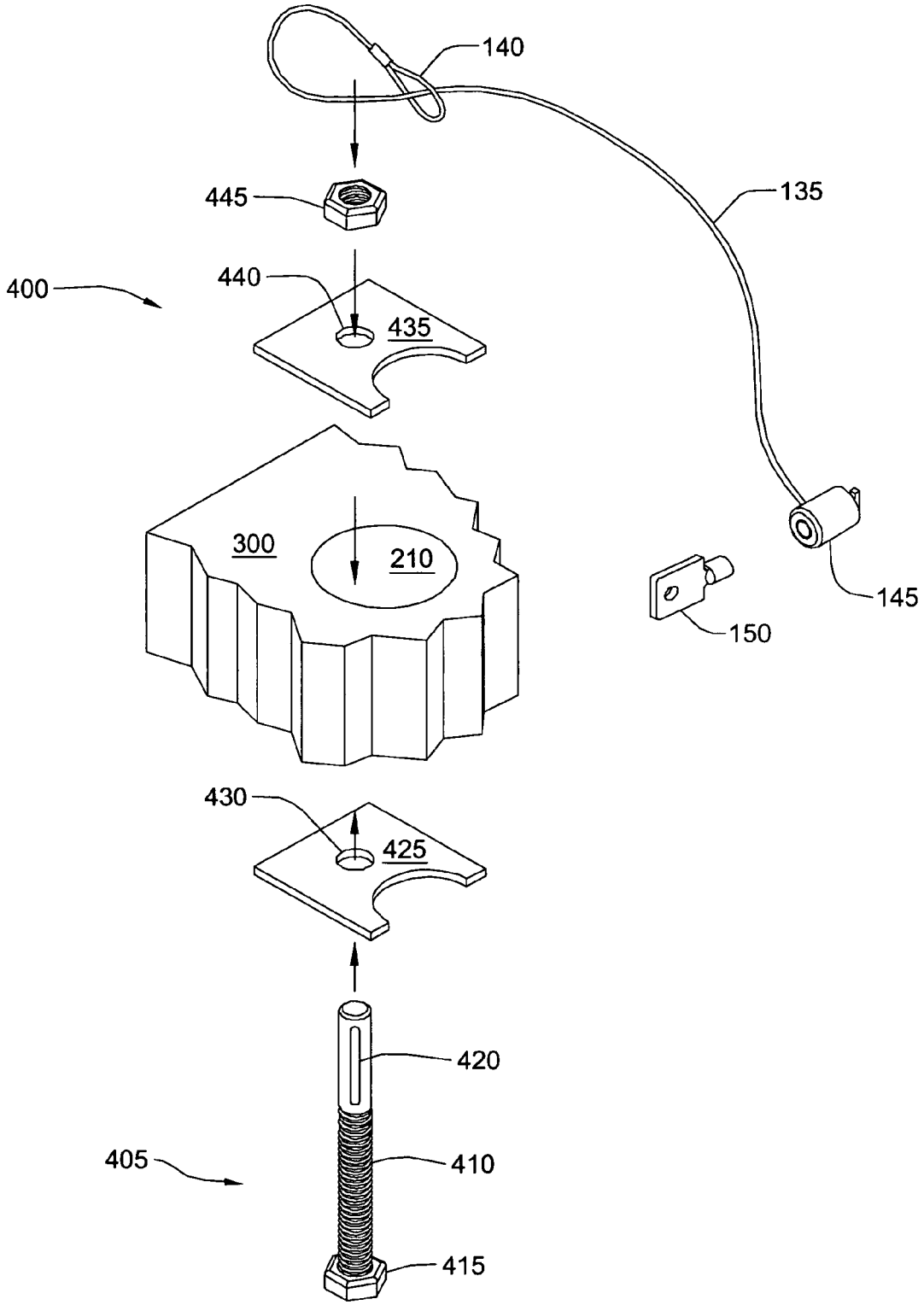
FIGS. 4A, 4B, and 4C respectively depict an exploded view, a top view, and a side view of an apparatus in accordance with an embodiment of the present invention.
Figure 4B:
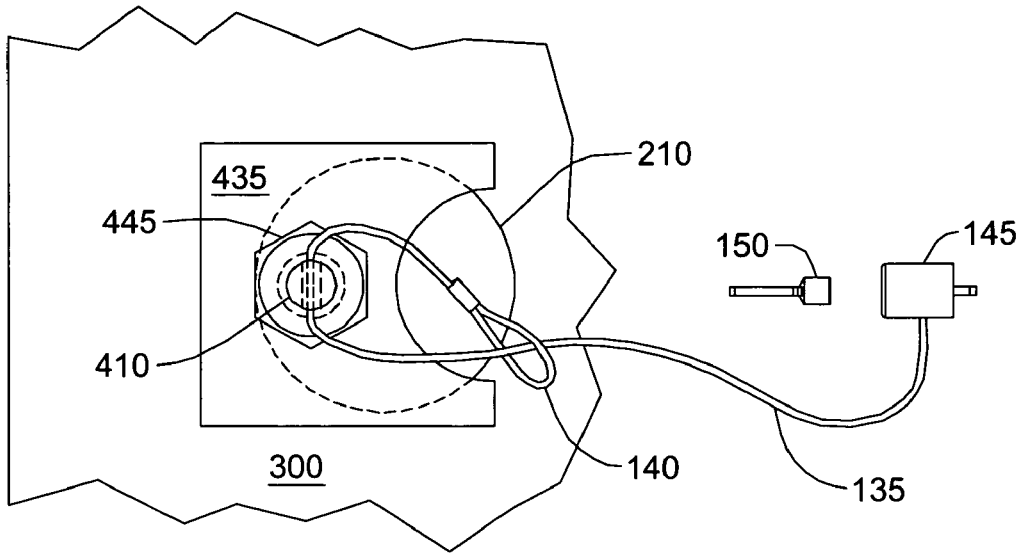
Figure 4C:
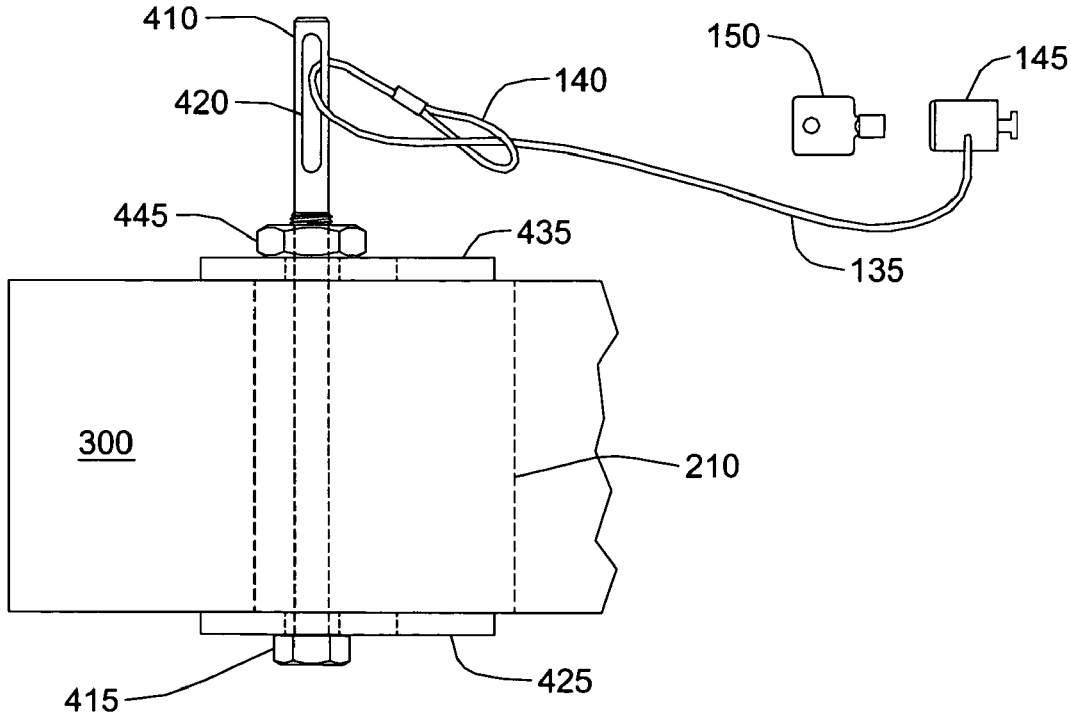

Referring now to FIGS. 4A, 4B, and 4C, an exploded view, a top view, and a side view of an embodiment of the present invention, apparatus 400 adapted to secure equipment at a workstation, are respectively depicted. Apparatus 400 comprises member 405 having shank 410 with head 415 at one end, and eye 420 at another end. Member 405 may comprise, in one example, a bolt comprised of hardened steel that is commonly used in bolts and other fasteners. However, any material that cannot be easily deformed or broken, such as aluminum, brass, copper, or a plastic such as Zytel® would be suitable for use with member 405. In FIG. 4A, exemplary threads are shown on shank 410 between head 415 and eye 420, however threads may be present on the entire length, only a portion, or none of shank 410 of member 405. Eye 420 should preferably be of a size such that loop 140 of security cable 135 may be passed through eye 420, such that eye 420 of member 405 is adapted to receive security cable 135.

Shank 410 of member 405 may be inserted and passed through first baffle 425 using first aperture 430. First baffle 425 may comprise, in one example, a plate of stainless steel sheet metal having a thickness of 12 gauge. However, different thicknesses may be used, and any material that cannot be easily deformed or broken, such as other types of (non-stainless) steel, aluminum, brass, copper, or a plastic such as Zytel® would be suitable for use with first baffle 425. First baffle 425 is depicted in FIGS. 4A, 4B, and 4C as having a shape that allows cables to be passed through hole 210 when first baffle 425 is installed. However, first baffle 425 may be implemented using a plurality of different shapes and/or sizes, so long as first baffle 425 may not be passed entirely through hole 210.

First aperture 430 may be formed in first baffle 425, for example, by drilling using a drill press, punching using a punch press, or if a plastic material is used for first baffle 425, by forming first aperture 430 when first baffle 425 is molded. Such processes for forming apertures are known, and further explanation is not believed necessary. First aperture 430 should preferably be of a size such that shank 410 of member 405 may be inserted and passed through first aperture 430 of first baffle 425, such that first aperture 430 of first baffle 425 is adapted to receive member 405. Head 415 of member 405 should preferably be of a size such that passage through first aperture 430 is prevented. In other embodiments (not shown), member 405 may be joined to, and have contact with, first baffle 425 by welding, for example, in a metal embodiment, using a high strength glue, or member 405 and first baffle 425 may be molded together as a single contiguous component, for example, in a plastic embodiment.

At least a portion of shank 410 of member 405 may be inserted and/or passed at least partially through hole 210 of workstation surface 300 of a workstation. In one embodiment, an end of security cable 135 having loop 140 may be passed through eye 420 of member 405 subsequent to member 405 having been inserted into hole 210 in surface 300 of a workstation. As mentioned hereinabove, eye 420 should preferably be of a size such that loop 140 of security cable 135 may be passed through eye 420. Once loop 140 has been passed through eye 420, an end of security cable 135 having lock 145 may be passed through loop 140. Equipment may then be secured by attaching lock 145 to the equipment using key 150.

In one embodiment, shank 410 of member 405 may be inserted and passed through second baffle 435 using second aperture 440 with second baffle 435 being on another side of hole 210 from first baffle 425. As with first baffle 425, second baffle 435 may comprise, in one example, a plate of stainless steel sheet metal having a thickness of 12 gauge. However, different thicknesses may be used, and any material that cannot be easily deformed or broken, such as other types of (non-stainless) steel, aluminum, brass, copper, or a plastic such as Zytel® would be suitable for use with second baffle 435. Second baffle 435 is depicted in FIGS. 4A, 4B, and 4C as having a shape that allows cables to be passed through hole 210 when second baffle 435 is installed. However, second baffle 435 may be implemented using a plurality of different shapes and/or sizes, so long as second baffle 435 may not be passed entirely through hole 210.

Second aperture 440 may be formed in second baffle 435, for example, by drilling using a drill press, punching using a punch press, or if a plastic material is used for second baffle 435, by forming second aperture 440 when second baffle 435 is molded. Such processes for forming apertures are known, and further explanation is not believed necessary. Second aperture 440 should preferably be of a size such that shank 410 of member 405 may be inserted and passed through second aperture 440 of second baffle 435, such that second aperture 440 of second baffle 435 is adapted to receive member 405.

In one embodiment, fastener 445 may be utilized to retain and secure member 405, first baffle 425, and second baffle 435. In one example, and as is depicted in FIGS. 4A, 4B, and 4C, fastener 445 may comprise a nut having internal threading that threads onto threads of shank 410 of member 405, however other types of fasteners such as a snap ring, or a pin that may be passed through eye 420 of member 405, or any other type of fastener suitable for retaining and securing member 405, first baffle 425, and second baffle 435, may also be utilized. Fastener 445 may further comprise hardened steel that is commonly used in nuts and other fasteners. Fastener 445 should preferably retain and secure member 405, first baffle 425, and second baffle 435 without unduly blocking access to eye 420 of member 405. In one example, fastener 445 should thread sufficiently far onto threads of shank 410 of member 405 such that eye 420 of member 405 extends at least partially beyond fastener 445, thereby allowing substantially unimpeded access to eye 420 of member 405.

In one embodiment, an end of security cable 135 having loop 140 may be passed through eye 420 of member 405 subsequent to member 405 having been retained and secured by fastener 445. As mentioned hereinabove, eye 420 should preferably be of a size such that loop 140 of security cable 135 may be passed through eye 420. Once loop 140 has been passed through eye 420, an end of security cable 135 having lock 145 may be passed through loop 140. Equipment may then be secured by attaching lock 145 to the equipment using key 150.

Figure 5A:
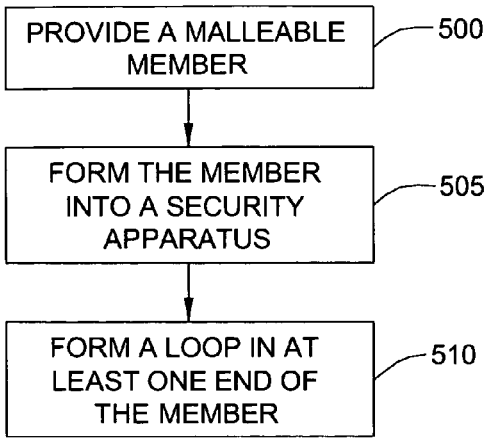
FIGS. 5A, 5B, and 5C are flow diagrams depicting apparatus construction and installation methods in accordance with embodiments of the present invention.
Figure 5B:
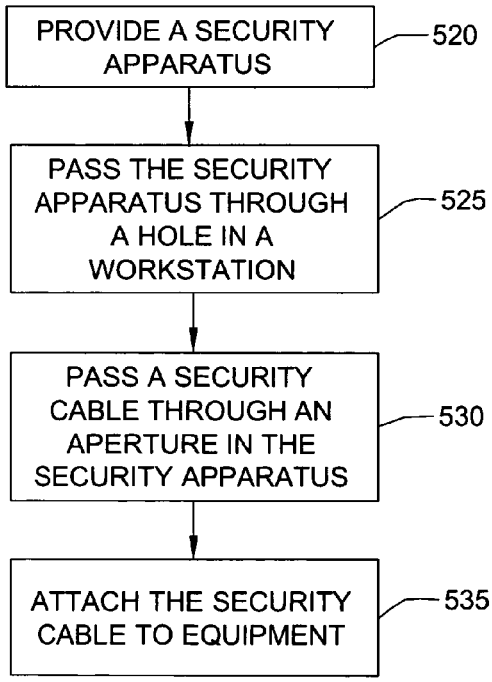
Figure 5C:
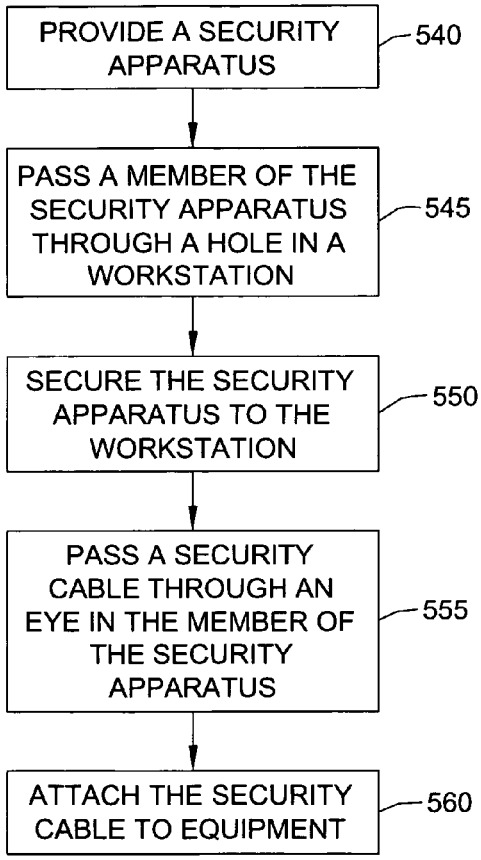

Referring now to FIGS. 5A, 5B, and 5C, flow diagrams describing apparatus construction and installation methods, in accordance with embodiments of the present invention, are depicted. FIG. 5A depicts a flow diagram of a method for constructing an apparatus adapted to secure equipment at a workstation. A malleable member is provided in step 500. The member is formed into a security apparatus in step 505, and a loop is formed in at least one end of the member in step 510.

FIG. 5B depicts a flow diagram of a method for securing equipment at a workstation. A security apparatus is provided in step 520. At least a portion of the security apparatus is passed through a hole in a surface of a workstation in step 525. At least one end of a security cable is passed through an aperture in the security apparatus in step 530, and the security cable is attached to equipment in step 535.

FIG. 5C depicts a flow diagram of a method for securing equipment at a workstation. A security apparatus is provided in step 540. At least a portion of a member of the security apparatus is passed through a hole in a surface of a workstation in step 545. The security apparatus is secured to the workstation in step 550, in one example, by threading fastener 445 onto threads of shank 410 of member 405 so as to retain and secure member 405, first baffle 425, and second baffle 435, as described hereinabove with reference to FIGS. 4A, 4B, and 4C. At least one end of a security cable is passed through an aperture or eye in the member of the security apparatus in step 555, and the security cable is attached to equipment in step 560.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A method for constructing an apparatus for securing equipment at a workstation, the method comprising:

providing a malleable member;

forming the member into an apparatus comprising a formed shape by bending the member such that a first portion of the apparatus may be passed through a hole in a surface of the workstation, while preventing a second portion of the apparatus from being passed through the hole, wherein ends of the member are contained in the first portion, wherein the member comprises a piece of metal or metal alloy that is sufficiently rigid so as to not be easily bent by hand more than one (1) inch from the formed shape while being sufficiently elastic and resilient so as to return to the formed shape when bent less than one (1) inch, and wherein the workstation comprises a desk;

forming a loop in at least one end of the member by bending the member, wherein the loop may be passed through the hole, and wherein a security cable may be passed through the loop; and providing the security cable, wherein the security cable is adapted to pass through the loop in the at least one end of the member, and wherein the security cable has a loop at one end for receiving another end of the security cable having a lock adapted to secure the equipment.

2. The method of claim 1, wherein the forming utilizes at least one of: a metal rolling machine, a sheet metal press, and a rod bending machine.

3. The method of claim 1, wherein the member is selected from the group consisting of a steel alloy wire of gauge twelve (12) or thicker, and a piece of extruded aluminum.

4. The method of claim 1, wherein the member has a plastic or painted coating.

5. An apparatus for securing equipment at a workstation, comprising:

a malleable metal member that is bent into an apparatus comprising a formed shape with at least one end of the member having a loop, wherein the member comprises a piece of metal or metal alloy that is sufficiently rigid so as to not be easily bent by hand more than one (1) inch from the formed shape while being sufficiently elastic and resilient so as to return to the formed shape when bent less than one (1) inch;

a first portion of the apparatus containing the loop at the at least one end that is passed through a hole in a surface of the workstation, wherein the loop at the at least one end of the member is adapted to receive a security cable, wherein the loop at the at least one end is formed by bending the at least one end of the member in a loop, and wherein the workstation comprises a desk;

a second portion of the apparatus that cannot be passed through the hole; and a security cable with a loop at one end for receiving another end of the security cable having a lock adapted to secure the equipment.

6. The apparatus of claim 5, wherein the member may be formed utilizing at least one of: a metal rolling machine, a sheet metal press, and a rod bending machine.

7. The apparatus of claim 5, wherein the member is selected from the group consisting of a steel alloy wire of gauge twelve (12) or thicker, and a piece of extruded aluminum.

8. A method for securing equipment at a workstation, the method comprising:

providing a malleable metal member that is bent into an apparatus comprising a formed shape with at least one end of the member having a loop, and having a first portion that may be passed through a hole in a surface of the workstation, wherein the member comprises a piece of metal or metal alloy that is sufficiently rigid so as to not be easily bent by hand more than one (1) inch from the formed shape while being sufficiently elastic and resilient so as to return to the formed shape when bent less than one (1) inch, wherein the at least one end of the member is included in the first portion, and a second portion that may not be passed through the hole, wherein the first portion has the loop at the at least one end for receiving a security cable, wherein the loop at the at least one end is formed by bending the at least one end of the member in a loop, and wherein the workstation comprises a desk;

passing the first portion of the apparatus through the hole in the surface of the workstation;

passing the security cable through the loop at the at least one end in the first portion of the apparatus; and attaching the security cable having a loop at one end for receiving another end of the security cable having a lock adapted to secure the equipment.

9. The method of claim 8, wherein the member may be formed utilizing at least one of: a metal rolling machine, a sheet metal press, and a rod bending machine.

10. The method of claim 8, wherein the member is selected from the group consisting of a steel alloy wire of gauge twelve (12) or thicker, and a piece of extruded aluminum.

* * * * *